US007377061B2

(12) United States Patent
Whittier et al.

(10) Patent No.: US 7,377,061 B2
(45) Date of Patent: May 27, 2008

(54) LIGHT BOX DISPLAY

(75) Inventors: Michael A. Whittier, Minneapolis, MN (US); Jeremy A. Clark, Minneapolis, MN (US); William Y. Stafford, Minnetrista, MN (US)

(73) Assignee: Target Brands, Inc., Minneapolis, MN (US)

( * ) Notice: Subject to any disclaimer, the term of this patent is extended or adjusted under 35 U.S.C. 154(b) by 375 days.

(21) Appl. No.: 10/958,017

(22) Filed: Oct. 4, 2004

(65) Prior Publication Data

US 2006/0070279 A1 Apr. 6, 2006

(51) Int. Cl.
*G09F 13/04* (2006.01)

(52) U.S. Cl. ..... 40/564; 40/574

(58) Field of Classification Search ..... 40/564, 40/674, 675, 541, 611.11, 617, 584; 248/475.1, 248/906, 343, 200.1
See application file for complete search history.

(56) References Cited

U.S. PATENT DOCUMENTS 2,006,573 A * 7/1935 Isenhour ..... 40/606.13
2,026,710 A * 1/1936 Smith ..... 40/573
2,163,329 A 6/1939 Sipior
2,303,988 A 12/1942 Christensen
2,366,695 A 1/1945 Bisheff
2,465,034 A * 3/1949 Peters ..... 40/574
2,939,235 A 6/1960 Wamser
3,666,936 A 5/1972 Webster, Jr. et al.
3,680,236 A * 8/1972 Arnold ..... 40/564
3,730,612 A * 5/1973 Arroyo et al. ..... 359/860
3,771,245 A 11/1973 Mabrey et al.
3,783,544 A 1/1974 Brody
4,000,573 A * 1/1977 Cohen ..... 40/620
4,165,573 A * 8/1979 Richards ..... 40/661
4,261,125 A * 4/1981 Rappaport ..... 40/367
4,263,736 A * 4/1981 Beierwaltes et al. ..... 40/452
4,287,555 A 9/1981 Stilling
4,414,489 A * 11/1983 Young ..... 315/51
4,621,443 A * 11/1986 Weinreich ..... 40/436
4,751,434 A * 6/1988 Helling et al. ..... 315/183
4,766,685 A 8/1988 Kramer
5,048,210 A 9/1991 Taylor et al.
5,214,870 A 6/1993 Cohen
5,373,428 A * 12/1994 Day ..... 362/223
5,457,905 A * 10/1995 Kaplan ..... 40/574
5,796,331 A * 8/1998 Lamparter ..... 340/433
6,037,064 A * 3/2000 Vicovanu et al. ..... 428/542.2
6,105,291 A 8/2000 Gabrius et al.

(Continued)

*Primary Examiner*—Lesley D. Morris
*Assistant Examiner*—Christopher E Veraa
(74) *Attorney, Agent, or Firm*—Ingrassia Fisher & Lorenz, P.C.

(57) ABSTRACT

A light box display for use in a retail environment including a light box, a graphic, and a graphic cover. The light box includes a base, a plurality of light sources secured within the base, and a light box cover. The light box cover includes an end wall, and the light box cover extends over the base to enclose the plurality of light sources between the base and the light box cover. The graphic extends over the end wall of the cover and is configured to be backlit by the plurality of light sources. The graphic cover extends over the graphic and the light box cover to secure the graphic to the light box. The graphic is viewable through the graphic cover. Retail displays and methods of presenting images to retail audiences provide additional advantages.

37 Claims, 8 Drawing Sheets

U.S. PATENT DOCUMENTS 6,224,244 B1 5/2001 Burys
6,449,888 B1 9/2002 Gibbs
2002/0144441 A1 10/2002 Zentmire et al.
2003/0051380 A1 3/2003 Butler et al.

* cited by examiner

LIGHT BOX DISPLAY

BACKGROUND OF THE INVENTION

Retail establishments typically use a wide variety of display systems to display products to consumers. Common display systems used in retail environments include hanging racks, gondolas, horizontally oriented display shelves, peg board systems, racks, end caps, display cases, and other devices. In order to draw attention to the products displayed, to assist the consumer in locating the particular item for which they are searching, and/or to add to the overall or departmental aesthetics of a retail establishment, signs are often placed in proximity to the displayed products. Such signs generally indicate the type of product, brand of product, advertising, other information helpful to the consumer or adding to an overall aesthetic feel of a retail establishment.

SUMMARY OF THE INVENTION

One aspect of the present invention relates to a light box display for use in a retail environment including a light box, a graphic, and a graphic cover. The light box includes a base, a plurality of light sources secured within the base, and a light box cover. The light box cover includes an end wall, and the light box cover extends over the base to enclose the plurality of light sources between the base and the light box cover. The graphic extends over the end wall of the cover and is configured to be backlit by the plurality of light sources. The graphic cover extends over the graphic and the light box cover to secure the graphic to the light box. The graphic is viewable through the graphic cover. Other features and advantages are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
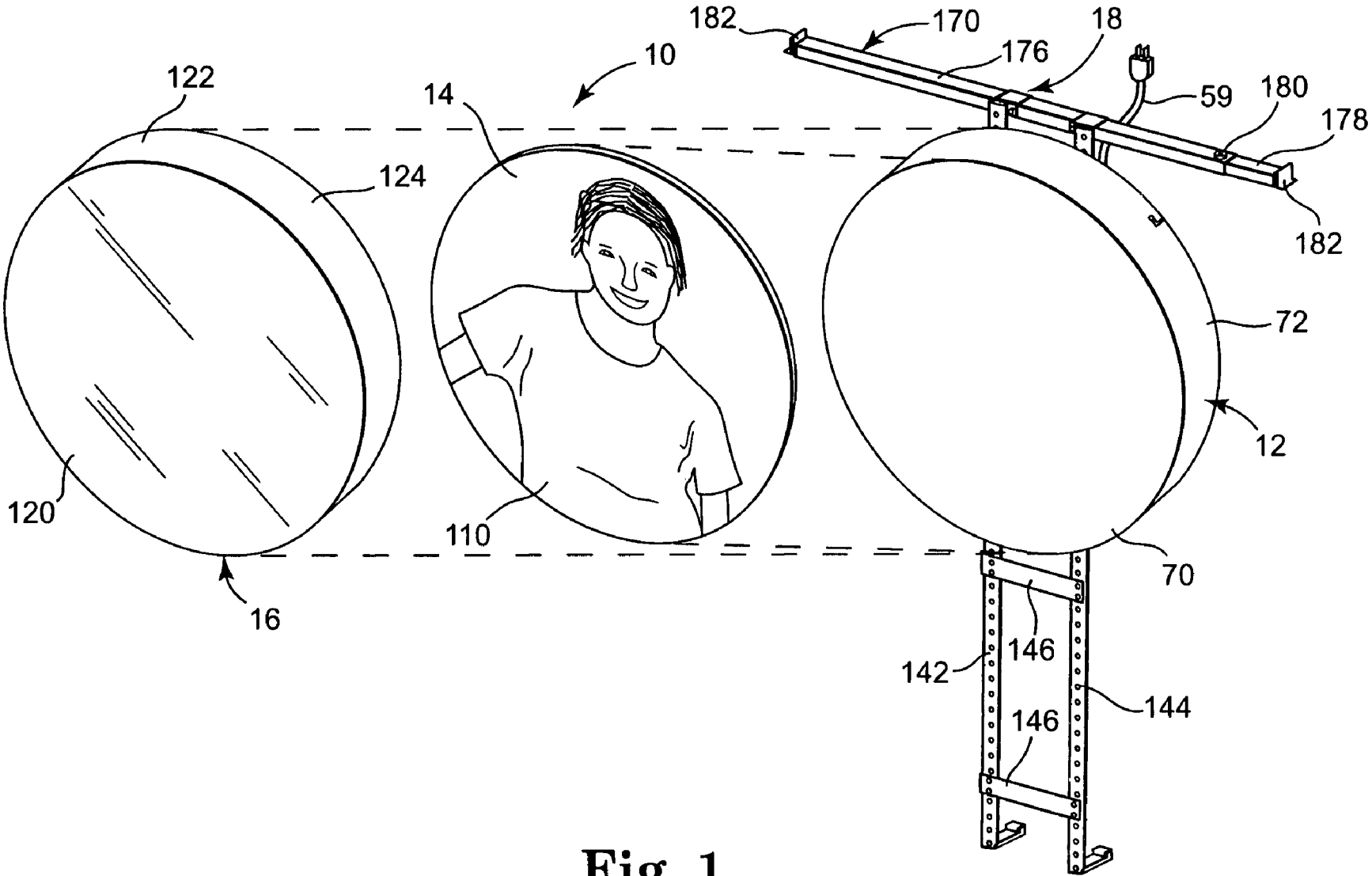
FIG. 1 is an exploded, perspective view of one embodiment of a light box display, according to the present invention.

FIG. 1 illustrates one embodiment of a light box display 10 for use within a retail establishment. Light box display 10 includes a light box 12, a graphic or image 14, and a graphic cover 16. Light box 12 is hung within a retail establishment from a mounting assembly 18 to receive and light up graphic 14, which, in one embodiment, relates to at least one of the retail establishment, brand name, trademark, department, sale, product type, overall aesthetic theme, etc. A graphic cover 16 is placed over graphic 14 to secure graphic 14 to light box 12 by interposing graphic 14 between light box 12 and graphic cover 16. Graphic cover 16 is clear or translucent to allow consumers to view graphic 14 through graphic cover 16. Accordingly, during use, graphic 14 is displayed with a backlit effect to produce a display aesthetically pleasing and interesting to consumers and other passersby.

Figure 2:
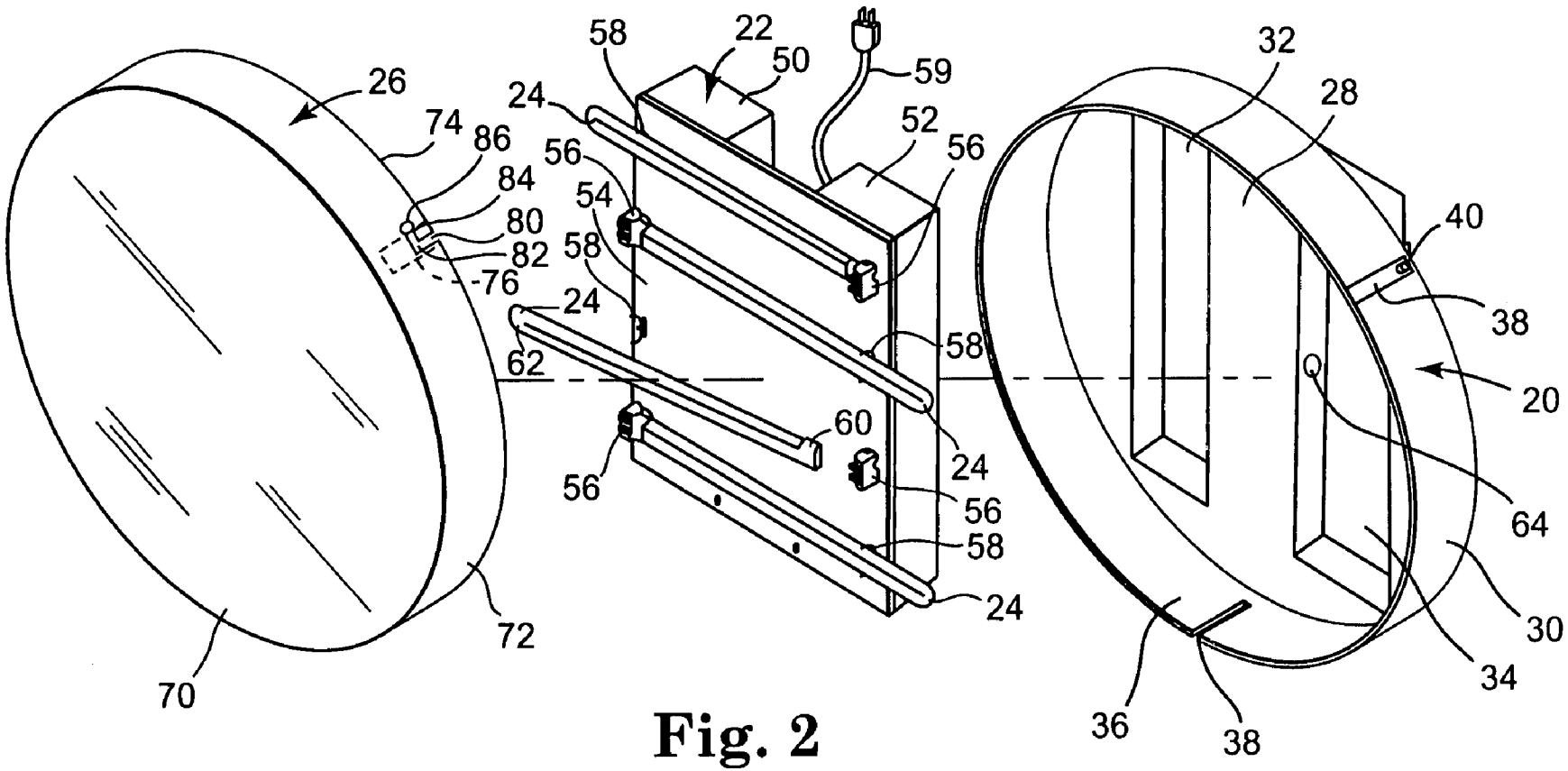
FIG. 2 is an exploded, perspective view of one embodiment of a light box of the light box display of FIG. 1, according to the present invention.

As illustrated in FIG. 2, light box 12 includes a base 20, a ballast assembly 22, a plurality of light bulbs 24, and a cover or lid 26. Base 20 includes an end wall 28 and a side wall 30. In one embodiment, end wall 28 is generally circular and generally planar and includes two recessed portions 32 and 34 sized to each receive a portion of ballast assembly 22. Side wall 30 extends perpendicularly from the perimeter of end wall 28 to define a cylinder with an opening 36 opposite end wall 28.

Side wall 30 includes a plurality of outwardly protruding registration rails 38 extending from opening 36 perpendicular to and toward end wall 28. In one embodiment, the plurality of registration rails 38 includes three protruding rails each circumferentially spaced from one another. A pin or flat headed peg 40 extends radially outwardly from each registration rail 38 near end wall 28. The plurality of registration rails 38 are positioned on base 20 to decrease or minimize the view of pegs 40 from the front of light box 12 upon assembly.

Base 20 is homogenously formed of a translucent or transparent material. In one embodiment, base 20 is formed of a translucent and diffuse plastic or acrylic material. More specifically, in one embodiment, base 20 is vacuum-formed of a milk colored acrylic, such as the frosted OPTIX® acrylic material. The diffuse and translucent or transparent nature of base 20 contributes to an even distribution of light projected from light box 12, as will be further described below. Even distribution of light from light box 12 contributes to the general aesthetics of light box display.

Ballast assembly 22 fits within base 20 and provides electricity to light box 12. In one embodiment, ballast assembly 22 includes a first ballast box 50, a second ballast box 52, and a ballast cover sheet 54. Ballast boxes 50 and 52 are spaced from one another, and in one embodiment, are electrically coupled to one another. Ballast cover sheet 54 is a metal plate extending between and over the front of ballast boxes 50 and 52 to increase the safety of light box 12. A plurality of sockets 56 and a plurality of bulb holders 58 extend from ballast cover sheet 54 in an alternating and staggered pattern.

Each of the plurality of sockets 56 is electrically coupled to one of ballast box 50 or ballast box 52, and each ballast box 50 and 52 provides electricity to support at least one of the plurality of sockets 56. An alternating current cord 59 extends from at least one of ballast boxes 50 and 52 for interfacing with an electrical source or outlet to introduce electricity to ballast assembly 22 and, thereby to sockets 56.

Each of the plurality of light bulbs 24, preferably fluorescent light bulbs, defines a first fixture end 60 and a second end 62. First fixture end 60 of each light bulb 24 selectively interfaces with one of the sockets 56, and second end 62 of each light bulb 24 is placed within one of the bulb holders 58. Accordingly, each light bulb 24 is securely positioned within base 20 between a socket 56 and a bulb holder 58. In one embodiment, the orientation of each light bulb 24 (i.e. positioning from first fixture end 60 to second end 62 or from second end 62 to first fixture end 60) is alternated and light bulbs 24 extend in an at least partially staggered manner. The staggered and alternating positioning of light bulbs 24 provides for an evenly dispersed emission of light from light box 12.

More specifically, in one example illustrated in FIG. 2, light bulbs 24 are spaced laterally (in this case, vertically) from each other and staggered longitudinally (in this case, horizontally left to right) such that a top light bulb 24 extends from a socket 56, which is coupled with second ballast box 52, over and beyond first ballast box 50. A second light bulb 24 positioned just below top light bulb 24 extends from a socket 56, which is coupled with first ballast box 50, over and beyond second ballast box 52. Additional light bulbs 24 are similarly staggered (i.e., are not horizontally aligned). The staggering of light bulbs 24 provides for a gradation of light collectively emitted from light bulbs 24 and diffused by cover 26 that presents viewers with a shimmering or meandering light effect. In the embodiment described above, light bulbs 24 are each centrally supported and second end 62 extends from the respective holder 58. With this in mind, second end 62 itself is not directly supported.

Ballast assembly 22 is received by placing each ballast box 50 and 52 in a respective recessed portion 32 and 34 of base 20. In one embodiment, at least one recessed portion 32 or 34 includes a hole 64 for cord 59 to extend from a ballast box 50 or 52 and through base 20. As a result, each socket 56 and bulb holder 58 is maintained within base 20 and extends toward base opening 36.

Light box cover 26 includes an end wall 70 and a side wall 72. End wall 70 is circular and, in one embodiment, generally planar. End wall 70 of cover 26 is sized slightly larger than end wall 28 of base 20. Side wall 72 extends perpendicularly from the perimeter of end wall 70 to form a hollow cylinder with an opening 74 opposite end wall 70. Side wall 72 extends from end wall 28 a distance similar to a distance side wall 30 extends from end wall 28 of base 20. In one embodiment, cover 26 is rounded at the interface between end wall 70 and side wall 72 to form a smoother, less abrupt transition between walls 70 and 72.

Side wall 72 includes a plurality of registration grooves 76 extending generally perpendicular to end wall 70 from opening 74. In one embodiment, three registration grooves 76 are circumferentially spaced about side wall 72. Each registration groove 76 is configured to receive one of the registration rails 38 of base 20. A locking notch 80 is defined within each registration groove 76. Each locking notch 80 extends entirely through the thickness of side wall 72 and includes a first portion 82 and a second portion 84. First portion 82 extends from opening 74 parallel to the general extension of registration groove 76 and partially toward end wall 70. Second portion 84 extends from first portion 82 opposite opening 74 with an orientation generally perpendicular to first portion 82. Each portion 82 and 84 has a width sufficient to receive peg 40. In one embodiment, each locking notch 80 includes a stop end 86 extending from second portion 84 opposite first portion 82 configured to selectively maintain peg 40 of base 20.

Cover 26 is homogenously formed of a translucent or transparent material. In one embodiment, cover 26 is formed of a translucent and diffuse plastic or acrylic material. More specifically, in one embodiment, cover 26 is vacuum-formed of a milk colored acrylic, such as the frosted OPTIX® acrylic material. The diffuse and translucent or transparent nature of cover 26 contributes to an even distribution of light projected from light box 12 as opposed to spot or line lighting, which is readily identifiable by consumers and other passersby. Accordingly, even distribution of light from light box 12 contributes to the general aesthetics of light box display 10.

Figure 3:
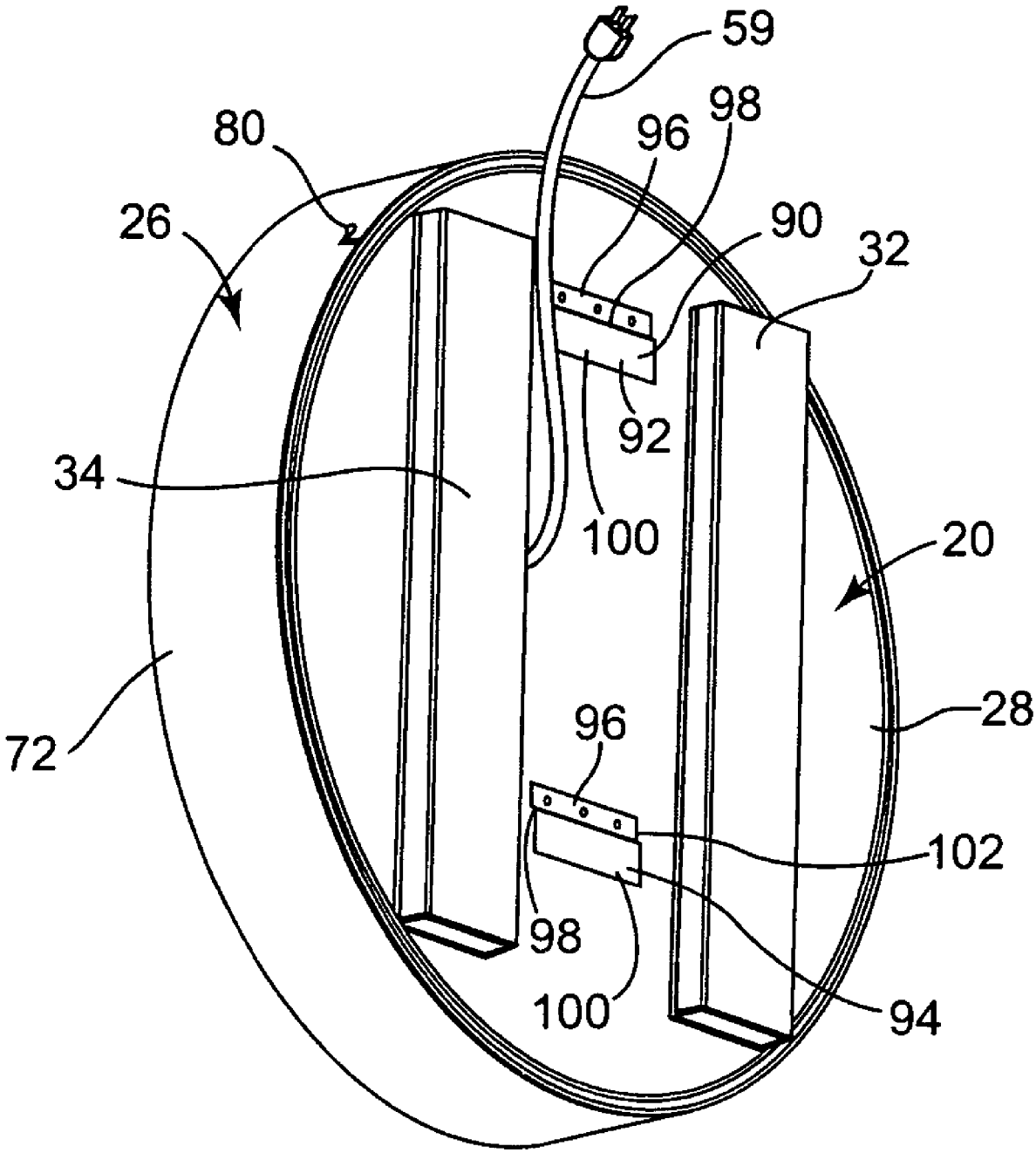
FIG. 3 is a back view of the light box of FIG. 2.

As illustrated in FIG. 3, in one embodiment, at least one mounting bracket 90 is secured to the back of base end wall 28. For example, at least one mounting bracket 90 includes a first mounting bracket 92 and a second mounting bracket 94. Each mounting bracket 92 and 94 is a Z-clip including a base interface portion 96, and intermediate portion 98, and a hanger interface portion 100. Base interface portion 96, intermediate portion 98, and hanger interface portion 100 are each generally planar and generally rectangular. Intermediate portion 98 extends from a bottom edge 102 of base interface portion 96 with an orientation generally perpendicular to base interface portion 96. Hanger interface portion 100 extends downwardly from intermediate portion 98 opposite base interface portion 96 with an orientation generally perpendicular to intermediate portion 98 and generally parallel to base interface portion 96.

Base interface portion 96 is secured to back of end wall 28 between recessed portions 32 and 34 with at least one screw, rivet, adhesive or other attachment device such that hanger interface portion 100 extends parallel to but spaced from end wall 28. In one embodiment, mounting brackets 92 and 94 are laterally aligned and vertically spaced from one another. More specifically, first mounting bracket 92 is secured to end wall 28 relatively near a top of end wall 28, while second mounting bracket 94 is spaced from first mounting bracket 92 and secured to end wall 28 relatively near a bottom of end wall 28. Each mounting bracket 92 and 94 is secured with a similar orientation, in particular, with hanger interface portion 100 extending downwardly from intermediate portion 98.

Referring to FIG. 1, graphic 14 is sized and shaped in a similar manner as end wall 28 of light box cover 26. More specifically, graphic 14 is any graphical and/or textual representation to be displayed by light box display 10. In particular, graphic 14 may depict graphics and/or text relating to one or more of brand name, retail establishment identification, trademark, department identification, product type, sale identification, general aesthetics, etc. In one embodiment, graphic 14 is a photograph of a subject 110, such as a model wearing a clothing item being offered for sale by the retail establishment. Graphic 14 is printed or otherwise formed upon a translucent or transparent print media, such as a transparency, vellum, DURATRAN® polyethylene or polyester material.

Graphic cover 16 is formed of acrylic, plastic, or other relatively rigid material that is translucent or, more preferably, transparent. For example, graphic cover 16 is vacuum-formed of clear acrylic or plastic. Graphic cover 16 is shaped similar to and sized slightly larger than light box cover 26. With this in mind, graphic cover 16 includes an end wall 120 and a side wall 122. In one embodiment, end wall 120 is round and generally planar and sized slightly larger than graphic 14. Side wall 122 extends around and generally perpendicularly from the perimeter of end wall 120 to define graphic cover 16 as a shallow cylinder with an open end 124. Side wall 122 extends from end wall 120 a distance similar to or slightly larger than the distance side wall 72 of light box cover 26 extends from end wall 70. In one embodiment, graphic cover 16 protects graphic 14 from staining or other incidental wear and tear during display of graphic 14 in a retail environment.

Figure 4:
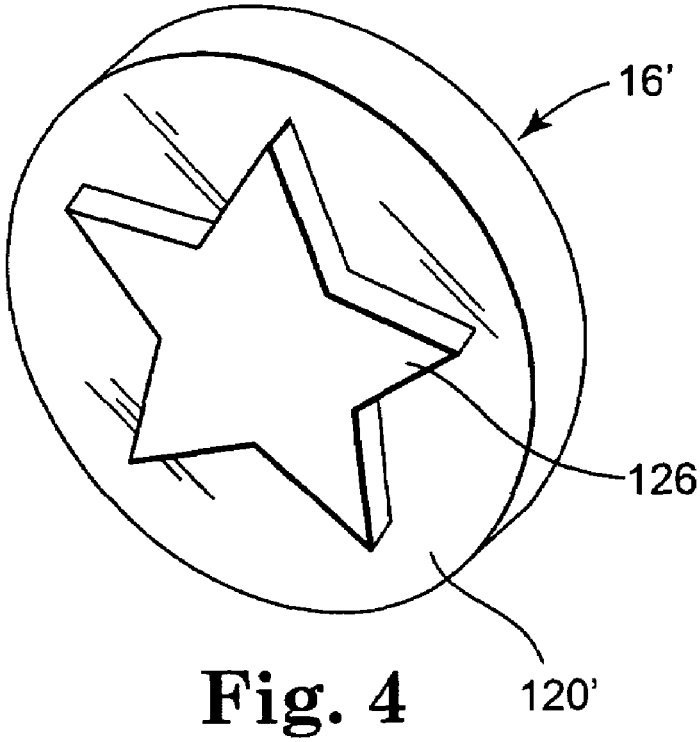
FIG. 4 is a perspective view of one embodiment of a graphic cover of the light box display of FIG. 1, according to the present invention.

FIG. 4 illustrates an alternate-embodiment graphic cover 16'. Graphic cover 16' is similar to graphic cover 16 in all respects other than those specifically described herein. Graphic cover 16' includes an end wall 120' having a perimeter shaped similar to and sized slightly larger than a perimeter of light box cover 26. End wall 120' includes at least one three-dimensional FIG. 126 protruding outwardly (i.e. in a direction opposite the direction side wall 122 extends from end wall 120') from the otherwise generally planar end wall 120'. In one embodiment, three-dimensional FIG. 126 relates one or more of brand name, retail establishment identification, trademark, department identification, product type, sale identification, general aesthetics, etc.

Figure 5:
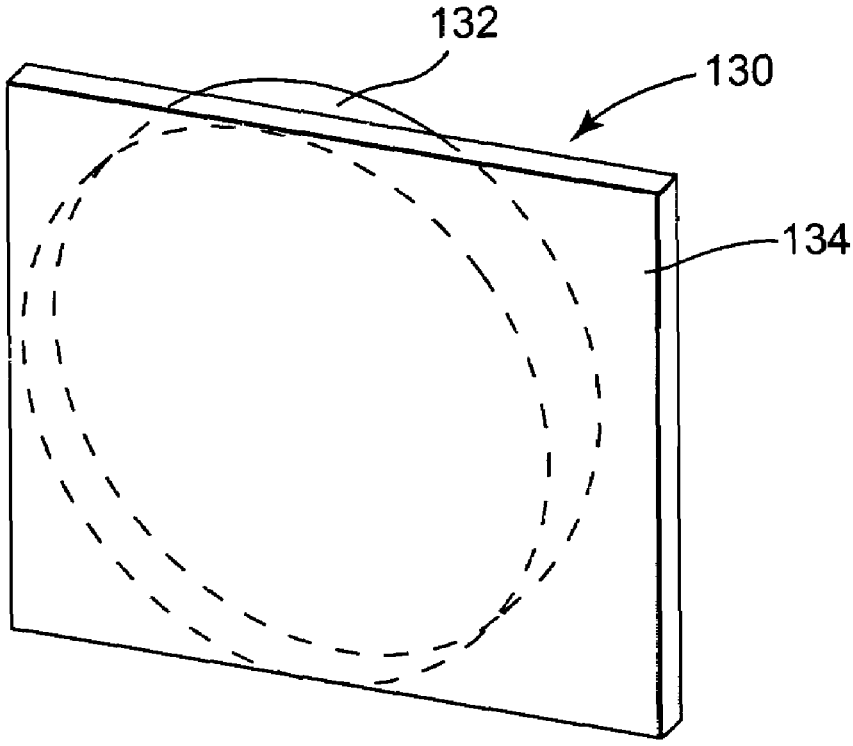
FIG. 5 is a perspective view of one embodiment of a graphic cover of the light box display of FIG. 1, according to the present invention.

FIG. 5 illustrates another embodiment of a graphic cover 130. Graphic cover 130 includes a side wall 132 and an end wall 134. Side wall 132 is sized and shaped similar to side wall 122 of graphic cover 16 described above. End wall 134 extends over and beyond a side or edge of side wall 132. End wall 134 includes the image to be displayed, which in other embodiments is included on graphic 14. Accordingly side wall 132 of graphic cover 130 is sized to be coupled with base 20 similar to graphic cover 16, but presents a non-circular external display to consumers and other passersby. Graphic cover 130 is formed acrylic, plastic, or other relatively rigid material that is translucent or transparent. In one embodiment, graphic cover 130 is vacuum-formed.

Figure 6:
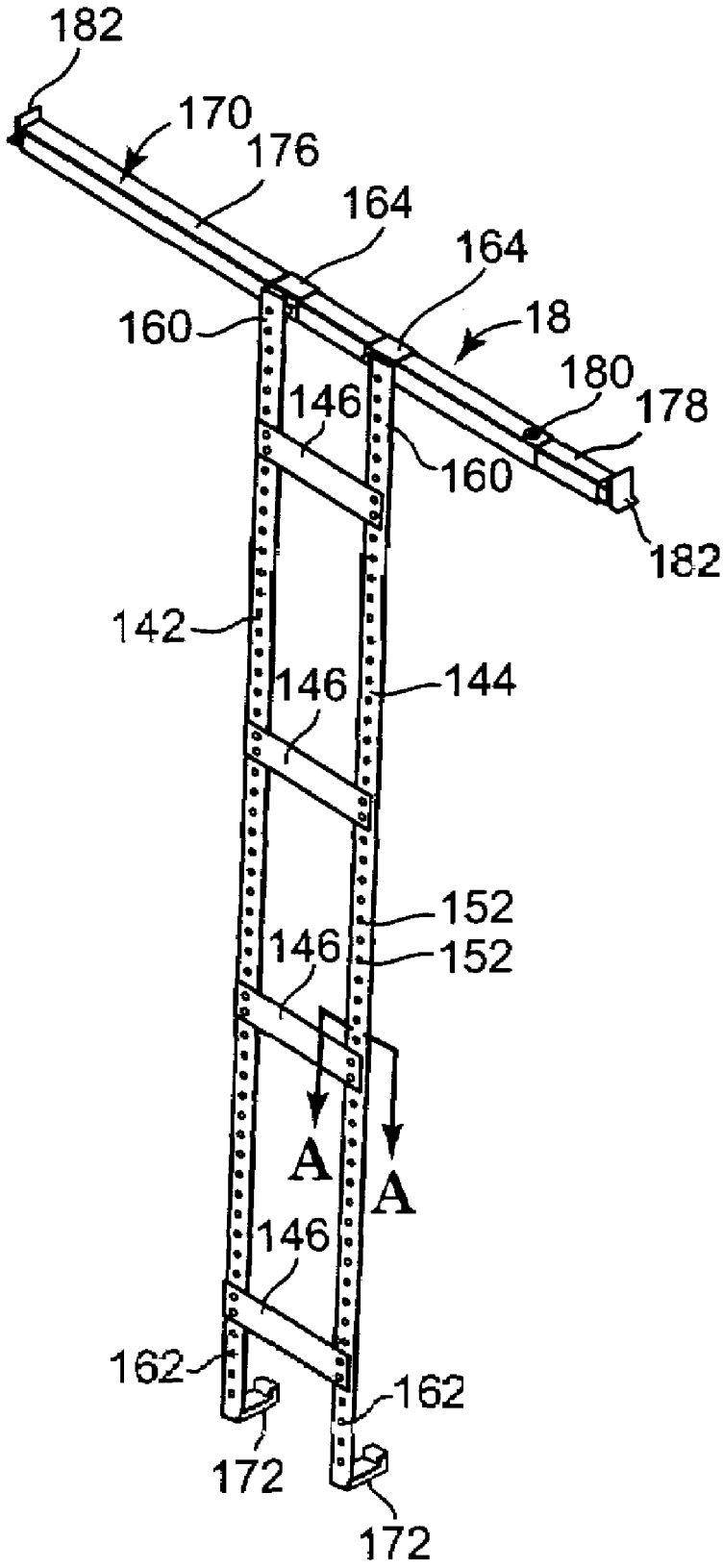
FIG. 6 is a perspective view of one embodiment of a mounting assembly used to hang the light box display of FIG. 1, according to the present invention.

As illustrated in FIG. 1, in one embodiment, light box display 10 is hung or supported by a mounting assembly 18. Additionally referring to FIG. 6, in one embodiment, mounting assembly 18 has a ladder-like construction including a first elongated, vertical support 142, a second elongated, vertical support 144, and a plurality of cross members 146. First and second vertical supports 142 and 144 are laterally spaced from one another a distance greater than the width of each mounting bracket 90 on base 20.

Each of the plurality of cross members 146 is secured to each of and extends between vertical supports 142 and 144. The plurality of cross members 146 are vertically spaced from one another, in particular, in one embodiment, at least two of the plurality of cross members 146 are vertically spaced apart from each other a distance equal to the vertical distance mounting brackets 90 are spaced apart from each other on base 20. In one example, each vertical support 142 and 144 and each cross member 146 is formed of powder-coated steel. Vertical supports 142 and 144 are channels and cross members 146 are rectangular plates.

Figure 6A:
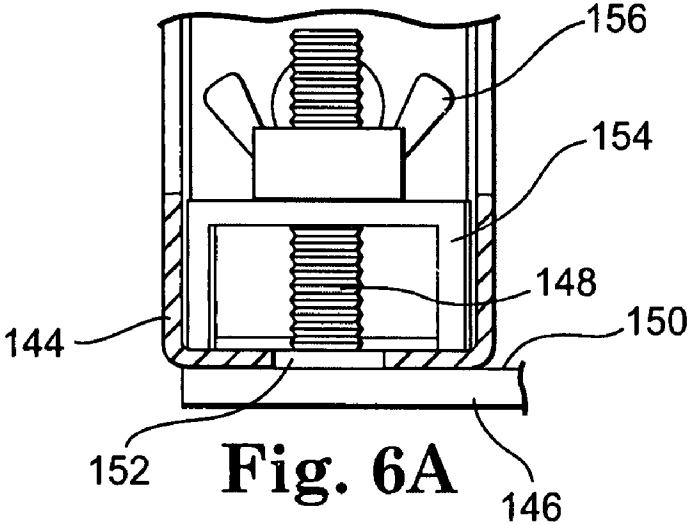
FIG. 6A is a cross-sectional view of a portion of the mounting assembly of FIG. 6 taken along the line A-A.

More specifically, in one embodiment illustrated in FIG. 6A, each cross member 146 includes at least one threaded stud 148 extending from a planar surface 150 of each cross member 146. Upon assembly with vertical supports 142 and 144, each threaded stud 148 is placed through a corresponding aperture 152 of the respective vertical support 142 or 144. A mounting channel 154 is placed within vertical support 142 or 144 with an opposite orientation as the channel of vertical support 142 or 144. Threaded stud 148 extends through mounting channel 154 opposite vertical support 142 or 144. A wing nut 156 is thread onto threaded stud 148 adjacent mounting channel 154 to securely hold cross member 146 to vertical support 142 or 144.

Each vertical support 142 and 144 defines a top end 160 and a bottom end 162 opposite top end 160. Top end 160 includes a hook 164 or other connection device for interfacing with a support rod 170. Hook 164 is configured to selectively receive support rod 170 to hang mounting assembly from support rod 170. In one embodiment, bottom end 162 of each vertical support 142 and 144 additionally includes a spacer 172 extending perpendicularly from vertical support 142 or 144 in a similar direction as hook 164 curves from vertical support 142 or 144.

Figure 7:
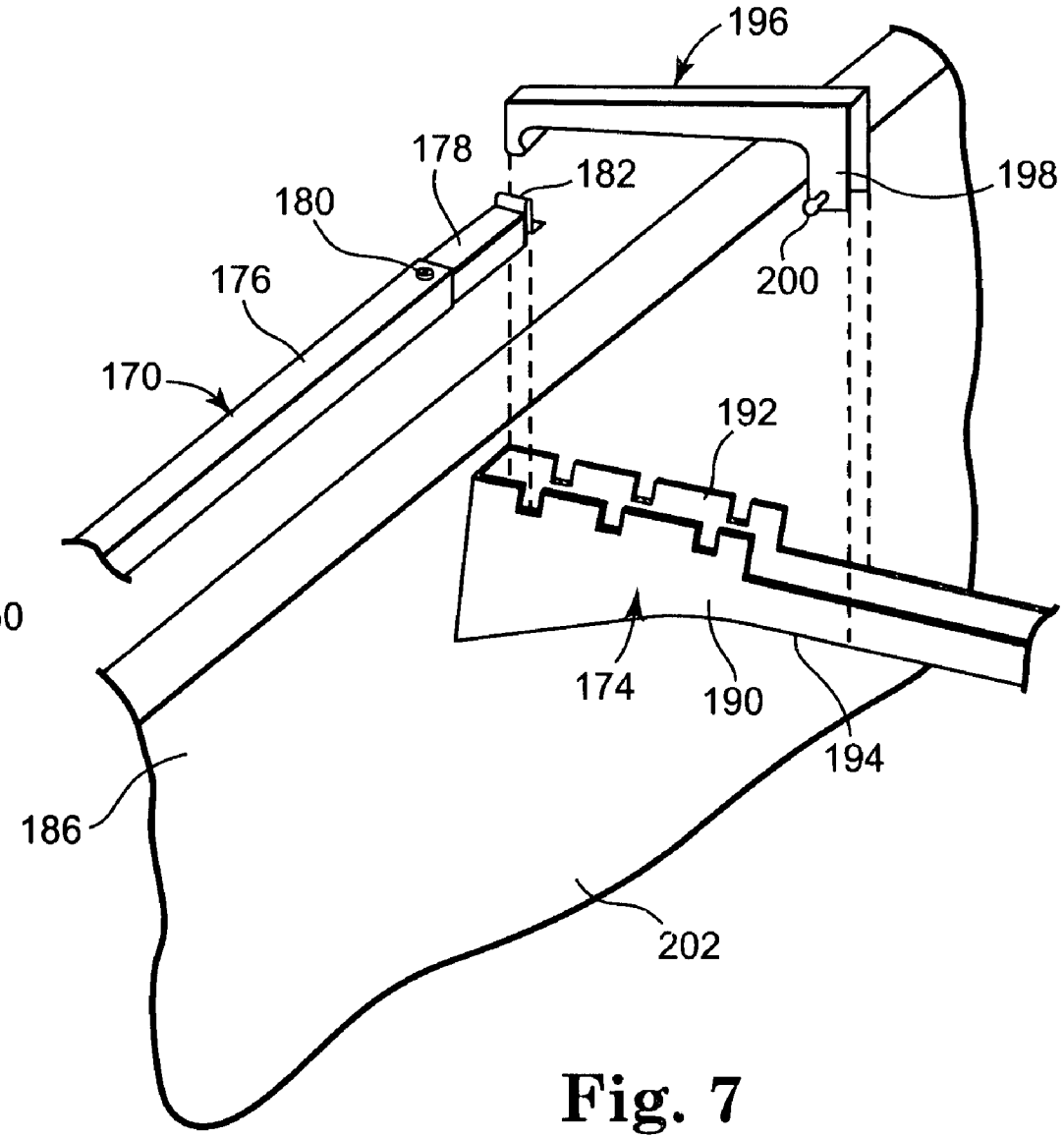
FIG. 7 is a detailed perspective view of one embodiment of a portion of the mounting assembly of FIG. 6 secured to a support structure, according to the present invention.

Referring to FIG. 7, support rod 170 is an elongated adjustable length support rod extending between two support struts 174. More particularly, in one embodiment, support rod 170 includes a first rod portion 176, a second rod portion 178 fit within and telescoping out of first rod portion 176, and a latch 180. Second rod portion 178 can longitudinally slide in and out of first rod portion 176 to lengthen or shorten support rod 170. Latch 180 includes a screw or clamp to selectively lock second rod portion 178 in the desired position with respect to first rod portion 176.

Support rod 170 additionally includes a hook or clip 182 or other attachment mechanism at each end of support rod 170. In one embodiment, clips 182 of support rod 170 interface with support struts 174 extending over a display area. As illustrated in FIG. 7, support struts 174 extend perpendicularly to a support wall 186, such as a permanent or semi-permanent support wall of the retail establishment. Each support strut 174 includes a first side panel 190, a second side panel 192 laterally spaced from first side panel 190, and a bottom panel 194 extending between bottom edges of first and second side panels 190 and 192. In one embodiment, first side panel 190 has a thickness sufficient to be received by and to maintain clips 182 of support rod 170.

Additionally, in one embodiment, following coupling of support rod 170 with support struts 174, a safety bar 196 is placed on each support strut 174 over at least a portion of clips 182. In particular, safety bar 196 is sized to be received between first and second side panels 190 and 192 of each support strut 174. More specifically, safety bar 196 extends between side panels 190 and 192 following insertion of clip 182 onto side panel 190.

In one embodiment, safety bar 196 includes a latch mechanism 198 extending from one end of safety bar 196 to a position beneath bottom panel 194. Safety bar 196 selectively latches or locks around bottom panel 194 of support strut 174. In one embodiment, latch mechanism 198 includes a screw or pin 200 that is selectively secured across bottom panel 194 to lock support rod 170 in place with respect to support strut 174. Accordingly, safety bar 196 increases the safety of the hung light box display 10 by decreasing the chance that support rod 170 would inadvertently be dislodged from support struts 174.

In order to hang light box display 10, mounting assembly 18 is lifted up to place hooks 164 over support rod 170. In one embodiment, spacers 172 of mounting assembly 150 interface with wall 186 to maintain the spacing of vertical supports 142 and 144 from wall 186. More specifically, in one example, vertical supports 142 and 144 extend parallel to a front surface 202 of wall 186. Once mounting assembly 18 is hung from support rod 170, base 20 of light box 12 with ballast assembly 22 is lifted and each mounting bracket 90 is placed to interface with one of cross members 146. In particular, one of the cross members 146 is placed between end wall 28 of base 20 and hanger interface portion 100 of mounting bracket 90. Accordingly, base 20 of light box 12 is hung from support rod 170 via mounting assembly 18.

Once base 20 is hung, light bulbs 24 are placed to interface with sockets 56 and to be held by bulb holders 58. Cord 59 is run up vertical support 142 or 144 to be electrically coupled with an outlet or other electrical source. With this in mind, light bulbs 24 are illuminated when electricity flows from the outlet or electrical source to sockets 56 via ballast boxes 50 and 52. Cover 26 is placed over base 20 such that each registration groove 76 receives a corresponding registration rail 38 of base 20. Cover 26 is slid further onto base 20 until peg 40 slides along first portion 82 of locking notch 80. Then, cover 26 is given a partial, clockwise turn to forward peg 40 through second portion 84 of locking notch 80 and to stop end 86 of locking notch 80 to selectively lock cover 26 to base 20.

Once cover 26 is secured to base 20, graphic 14 is placed over cover 26 to block direct viewing of end wall 70 of cover 26. In one embodiment, graphic 14 selectively adheres to cover 26 due to static cling or with an other adhesive. In such an embodiment, graphic cover 16 is optional. In some instances, directly adhering graphic 14 to cover 26 due to static cling or other adhesive causes wrinkles to be formed in graphic 14. Therefore, in other embodiments, graphic 14 is characterized by a lack of direct adherence to cover 26 due to static cling or use of adhesive. Graphic cover 16 is placed over graphic 14 and light box cover 26. Graphic cover 16 is secured over light box cover 26 to interpose and secure graphic 14 between end wall 120 of graphic cover 16 and end wall 70 of light box cover 26. In this manner, graphic cover 16 also protects graphic 14 from wear during display.

In one embodiment, graphic cover 16 is secured to light box cover 26 by a friction fit and/or static build up between side wall 122 of graphic cover 16 and side wall 72 of light box cover 26. In other embodiments, graphic cover 16 is secured to light box cover 26 with plastic clips. Once assembled, graphic 14 is viewable to consumers or other passersby in a backlit manner. Graphic covers 16' and 130 can similarly be attached. In other embodiments, in which graphic cover 16, 16', or 130 is painted or otherwise depicts the image to be displayed, use of graphic 14 is optionally eliminated.

Figure 8:
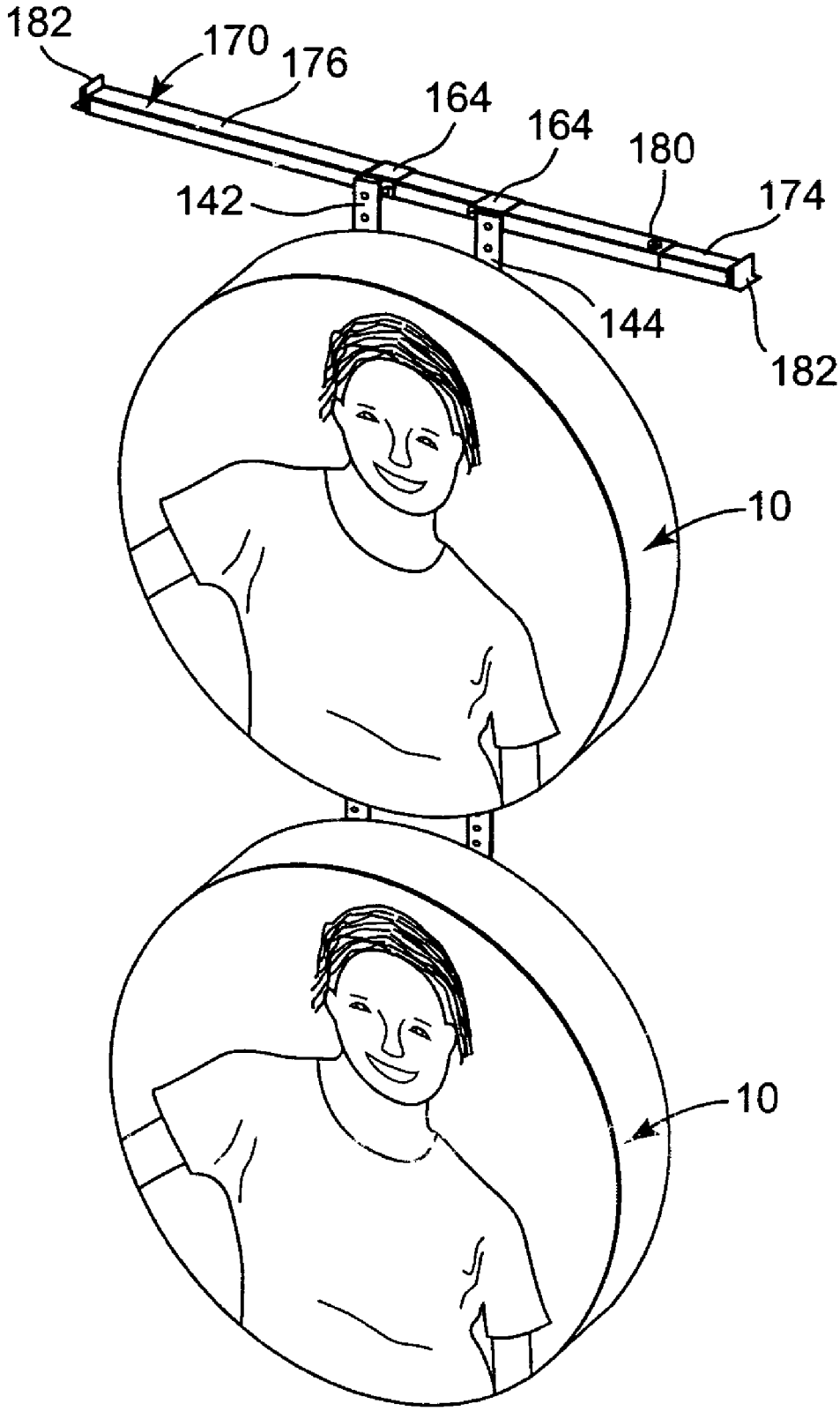
FIG. 8 is a perspective view of one embodiment of a product display system incorporating a plurality of the light box displays, according to the present invention.

In one embodiment, mounting assembly 18 includes four cross members 146 wherein each set of two cross members 146 supports one light box display 10. Accordingly, as illustrated in FIG. 8, two light box displays 10 can be hung on a single mounting assembly 18. In other embodiments, mounting assembly 18 only includes two cross members 146 and, therefore, only supports one light box display 10. Graphic cover 16 and graphic 14 are removed from light box display 10 in the opposite manner as they were secured to light box display 10. Similarly, light box 12 and mounting assembly 18 are removed and taken down from support rod 170 in the opposite manner as they were secured to light box display 10.

Figure 9:
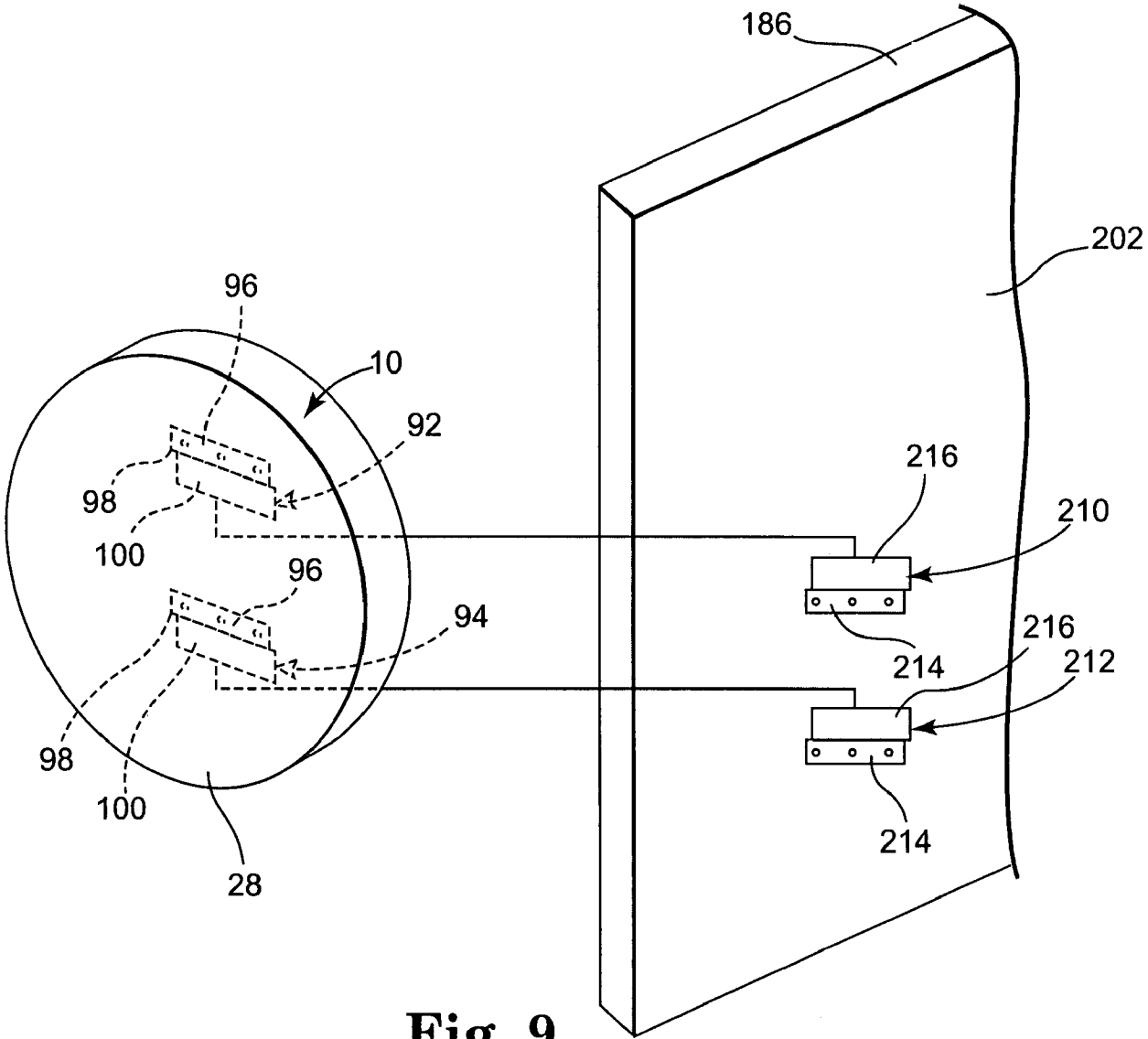
FIG. 9 is a perspective view of one embodiment of an alternate mounting system for hanging the light box display of FIG. 1, according to the present invention.

FIG. 9 illustrates an alternate embodiment of a method of hanging light box display 10. In this embodiment, two Z-clips or other mounting brackets 210 and 212 are hung on front surface 202 of wall 186. Accordingly each clip 210 and 212 includes a wall interface portion 214 and a display interface portion 216 similar to base interface portion 96 and hanger interface portion 100 of mounting brackets 92 and 94 of light box display 10. Each wall interface portion 214 is secured to wall 186 with at least one screw, adhesive, or other attachment device such that display interface portion 216 extends upwardly from the remainder of clip 210 or 212.

In one embodiment, clips 210 and 212 are laterally aligned and vertically spaced from one another to interface with mounting brackets 92 and 94 of light box display 10. More specifically, to hang light box display 10, light box display 10 is positioned such that hanger interface portion 100 of mounting brackets 92 and 94 are placed between display interface portion 216 of the respective clip 210 and 212 and front surface 202 of wall 186, thereby securing light box display 10 to wall 186.

In one embodiment, one or more light box displays 10 are arranged for use in combination with product display articles, such as the display articles described in U.S. patent application Ser. No. 10/958,142 for a "Retail Display Article and System", filed concurrently with the present application on Oct. 4, 2004, which is hereby incorporated by reference herein. In one example, one or more light box displays 10 are hung above, below, beside, spaced from, and/or aligned with a display article imitating a mannequin wearing or displaying a product for sale. In other examples, one or more light box displays 10 are hung with display panels hung in a three-dimensional manner, such as Light box displays according to the present invention provide for an aesthetically pleasing way of presenting text or other images to a retail audience including retail consumers and other passersby. By providing for the backlit display of the graphics with a diffused light, the light display draws consumer attention and is yet pleasing to the eye of the consumer or other passersby. In addition, the modular nature of the light box display allows a single light box to be interchangeably used with various graphics and/or graphic covers. In this manner, the overall look of the light box display can be altered by changing the graphic and/or graphic cover without the added expense of providing a new light box for each altered display.

Although the invention has been described with respect to particular embodiments, such embodiments are for illustrative purposes only and should not be considered to limit the invention. Various alternatives and change will be apparent to those of ordinary skill in the art. For example, although generally described as being round or cylindrical, a light box can be formed in a variety of shapes and sizes. Additional modifications and changes will further be apparent to those of ordinary skill in the art.

What is claimed is:

1. A light box display for use in a retail environment, the light box display comprising:

a light box, the light box including:

a base, a plurality of light sources secured within the base, and a light box cover including an end wall, wherein the light box cover extends over the base to enclose the plurality of light sources between the base and the light box cover;

a graphic extending over the end wall of the cover, wherein the graphic is configured to be backlit by the plurality of light sources; and a graphic cover extending over the graphic and the light box cover to secure the graphic to the light box, wherein the graphic is viewable through the graphic cover;

wherein the light box further includes at least one mounting bracket coupled to the base to facilitate hanging of the light box, and the light box display further comprises:

a mounting assembly configured to receive the at least one mounting bracket to support the light box, wherein the mounting assembly includes an adjustable length support rod configured to extend between two supports spaced from each other in the retail environment.

2. The light box display of claim 1, wherein the mounting assembly includes a safety bar configured to lock the adjustable length support rod to each of the two supports.

3. The light box display of claim 1, wherein the mounting assembly is configured to receive a second light box.

4. The light box display of claim 1, wherein the plurality of light sources includes a plurality of light bulbs longitudinally staggered and laterally spaced from each other inside the base.

5. The light box display of claim 4, wherein the base includes at least one bulb holder, and each of the plurality of light bulbs interfaces with one of the at least one bulb holder of the base and includes at least one end extending from a corresponding one of the at least one bulb holder.

6. The light box of display claim 1, wherein the base and the light box cover are each formed of a material configured to at least partially diffuse the light emanating from the plurality of light sources.

7. The light box display of claim 6, wherein the base and the light box cover are each formed of milk colored acrylic.

8. The light box display of claim 1, wherein the light box further includes a ballast assembly secured within the base and transferring electricity to the plurality of light sources.

9. The light box display of claim 8, wherein the base includes at least one recessed portion configured to receive at least a portion of the ballast assembly.

10. The light box of claim 1, wherein the base includes a base side wall and the light box cover includes a cover side wall, and further wherein the cover side wall generally fits around and overlaps an entirety of the base side wall.

11. The light box display of claim 10, wherein the base side wall includes at least one rail and the cover side wall includes at least one groove configured to be received by the at least one rail to align the light box cover with the base.

12. The light box of claim 10, wherein the base side wall includes at least one peg and the cover side wall includes at least one locking notch configured to receive the at least one peg to selectively lock the light box cover to the base.

13. The light box display of claim 10, wherein the graphic cover includes a graphic cover side wall, wherein the graphic cover side wall is configured to generally fit around and overlap an entirety of the cover side wall of the light box cover.

14. The light box display of claim 13, wherein the graphic cover includes an end wall and a three-dimensional figure extending from the end wall.

15. A method of presenting an image to a retail audience, the method comprising:

providing a light box including a first member and a second member configured to collectively house a plurality of light sources;

hanging a mounting assembly between a first support and a second support;

hanging the light box on the mounting assembly between the first support and the second support;

coupling a graphic to the light box; and backlighting the graphic with light provided by the plurality of light sources;

wherein the mounting assembly includes a support rod, and further wherein hanging the mounting assembly includes coupling a first end of the support rod to the first support, coupling a second end of the support rod to the second support and adjusting the length of the support rod to fit between and interface with each of the first support and the second support.

16. A method of presenting an image to a retail audience, the method comprising:

providing a light box including a first member and a second member configured to collectively house a plurality of light sources;

hanging a mounting assembly between a first support and a second support;

hanging the light box on the mounting assembly between the first support and the second support;

coupling a graphic to the light box; and backlighting the graphic with light provided by the plurality of light sources;

wherein the mounting assembly includes a support rod, and further wherein hanging the mounting assembly includes coupling a first end of the support rod to the first support, coupling a second end of the support rod to the second support, and wherein the mounting assembly further includes a first elongated member, a second elongated member spaced from the first elongated member, and at least one cross member extending between the first elongated member and the second elongated member, and further wherein hanging the mounting assembly includes coupling a first end of each of the first and second elongated members to the support rod.

17. The method of claim 16, wherein the first end of each of the first and second elongated members defines a hook, and coupling the first end of each of the elongated members to the support rod includes placing the hook of each of the elongated members to receive the support rod.

18. The method of claim 16, wherein hanging the light box on the mounting assembly includes securing at least one mounting bracket to the light box and coupling the at least one mounting bracket to one of the at least one cross member of the mounting assembly.

19. The method of claim 16, wherein hanging the mounting assembly includes providing a spacer at a second end opposite the first end of each of the first and second elongated members to maintain each of the first and second elongated members with a generally vertical orientation upon hanging.

20. A method of presenting an image to a retail audience, the method comprising:

providing a first light box including a first member and a second member configured to collectively house a plurality of light sources;

hanging a mounting assembly between a first support and a second support;

hanging the first light box on the mounting assembly between the first support and the second support;

coupling a graphic to the first light box including securing a graphic cover to the first light box with one of static build up and friction fit to interpose the graphic between the first light box and the graphic cover;

backlighting the graphic with light provided by the plurality of light sources; and hanging a second light box on the mounting assembly;

wherein the mounting assembly includes two elongated members, a first cross member, and a second cross member spaced from the first cross member, wherein each of the first cross member and the second cross member extend between the two elongated members, and further wherein hanging the first light box includes coupling the first light box to the first cross member and hanging the second light box includes coupling the second light box to the second cross member.

21. A method of presenting an image to a retail audience, the method comprising:

providing a light box including a first member and a second member configured to collectively house a plurality of light sources;

hanging a mounting assembly between a first support and a second support;

hanging the light box on the mounting assembly between the first support and the second support;

coupling a graphic to the light box including securing a graphic cover to the light box with one of static build up and friction fit to interpose the graphic between the light box and the graphic cover; and backlighting the graphic with light provided by the plurality of light sources;

wherein the light box further includes a ballast assembly secured within the first member of the light box and configured to transfer electricity to the plurality of light sources, and the first member of the light box includes at least one recessed portion configured to receive at least a portion of the ballast assembly.

22. The method of claim 21, wherein the plurality of light sources includes a plurality of light bulbs which are longitudinally staggered and laterally spaced from each other inside the first member of the light box.

23. A method of presenting an image to a retail audience, the method comprising:

providing a light box including a first member and a second member configured to collectively house a plurality of light sources;

hanging a mounting assembly between a first support and a second support;

hanging the light box on the mounting assembly between the first support and the second support;

coupling a graphic to the light box including securing a graphic cover to the light box with one of static build up and friction fit to interpose the graphic between the light box and the graphic cover; and backlighting the graphic with light provided by the plurality of light sources;

wherein the first member of the light box includes a first member side wall and the second member of the light box includes a second member side wall, and further wherein the second member side wall generally fits around and overlaps an entirety of the first member side wall.

24. The method of claim 23, wherein the first member side wall includes at least one rail and the second member side wall includes at least one groove configured to be received by the at least one rail to align the second member with the first member.

25. The method of claim 23, wherein the first member side wall includes at least one peg and the second member side wall includes at least one locking notch configured to receive the at least one peg to selectively lock the second member to the first member.

26. The method of claim 23, wherein coupling the graphic to the light box includes securing the graphic between the light box and a graphic cover, the graphic cover including a graphic cover side wall, wherein the graphic cover side wall is configured to generally fit around and overlap an entirety of the second member side wall.

27. The method of claim 26, wherein the graphic cover includes an end wall and a three-dimensional figure extending from the end wall.

28. The method of claim 23, wherein the mounting assembly includes a support rod, and further wherein hanging the mounting assembly includes coupling a first end of the support rod to the first support and coupling a second end of the support rod to the second support.

29. The method of claim 28, wherein hanging the mounting assembly includes coupling a first safety lock to the first support and a second safety lock to the second support to selectively lock the support rod to each of the first support and second support.

30. The method of claim 23, wherein the plurality of light sources includes a plurality of light bulbs which are longitudinally staggered and laterally spaced from each other inside the first member of the light box.

31. The method of claim 30, wherein the first member of the light box includes at least one bulb holder, and each of the plurality of light bulbs interfaces with one of the at least one bulb holder and includes at least one end extending from a corresponding one of the at least one bulb holder.

32. The method of claim 23, wherein the first member and the second member of the light box are each formed of a material configured to at least partially diffuse the light emanating from the plurality of light sources.

33. A method of presenting an image to a retail audience, the method comprising:

providing a light box including a first member and a second member configured to collectively house a plurality of light sources;

hanging a mounting assembly between a first support and a second support;

hanging the light box on the mounting assembly between the first support and the second support;

coupling a graphic to the light box including securing a graphic cover to the light box with one of static build up and friction fit to interpose the graphic between the light box and the graphic cover; and backlighting the graphic with light provided by the plurality of light sources;

wherein the light box defines a first end wall and a first side wall extending around an outer perimeter of the first end wall, and the graphic cover defines a second end wall and a second side wall extending around an outer perimeter of the second end wall, and coupling the graphic to the light box positions the graphic between and adjacent to each of the first end wall and the second end wall; and wherein securing the graphic cover to the light box positions the second end wall to extend over the first end wall and positions the second side wall to extend around the first side wall.

34. The method of claim 33, wherein the mounting assembly includes a support rod, and further wherein hanging the mounting assembly includes coupling a first end of the support rod to the first support and coupling a second end of the support rod to the second support.

35. The method of claim 34, wherein hanging the mounting assembly includes coupling a first safety lock to the first support and a second safety lock to the second support to selectively lock the support rod to each of the first support and second support.

36. The method of claim 33, wherein the first side wall extends substantially perpendicular to the first end wall, and the second side wall extends substantially perpendicular to the second end wall.

37. The method of claim 33, wherein the plurality of light sources includes a plurality of light bulbs which are longitudinally staggered and laterally spaced from each other inside the first member of the light box.

* * * * *